US007457744B2

(12) United States Patent
Lee et al.

(10) Patent No.: US 7,457,744 B2
(45) Date of Patent: Nov. 25, 2008

(54) METHOD OF ESTIMATING PITCH BY USING RATIO OF MAXIMUM PEAK TO CANDIDATE FOR MAXIMUM OF AUTOCORRELATION FUNCTION AND DEVICE USING THE METHOD

(75) Inventors: Mi-suk Lee, Daejeon (KR); Dae-hwan Hwang, Daejeon (KR)

(73) Assignee: Electronics and Telecommunications Research Institute (KR)

( * ) Notice: Subject to any disclaimer, the term of this patent is extended or adjusted under 35 U.S.C. 154(b) by 892 days.

(21) Appl. No.: 10/628,058

(22) Filed: Jul. 25, 2003

(65) Prior Publication Data

US 2004/0073420 A1 Apr. 15, 2004

(30) Foreign Application Priority Data

Oct. 10, 2002 (KR) ..... 10-2002-0061787

(51) Int. Cl.
*G10L 11/04* (2006.01)

(52) U.S. Cl. ..... 704/207; 704/217; 704/223; 704/214

(58) Field of Classification Search ..... 704/223, 704/220, 208, 217, 207, 216, 219, 224, 222, 704/221, 218
See application file for complete search history.

(56) References Cited

U.S. PATENT DOCUMENTS 6,199,035 B1 * 3/2001 Lakaniemi et al. ..... 704/207
6,415,252 B1 * 7/2002 Peng et al. ..... 704/208
6,594,626 B2 * 7/2003 Suzuki et al. ..... 704/220
6,804,639 B1 * 10/2004 Ehara ..... 704/223

OTHER PUBLICATIONS

Pasi Ojala et al.,; "A Novel Pitch-Lag Search Method Using Adaptive Weighting and Median Filtering"; Nokia Research Center; 0-7803-5651-9/11; 1999 IEEE pp. 114-116.

* cited by examiner

*Primary Examiner*—Huyen X Vo
(74) *Attorney, Agent, or Firm*—Blakely, Sokoloff, Taylor & Zafman

(57) ABSTRACT

A device and a method for estimating an open-loop pitch in a general speech CODEC are disclosed. The open-loop pitch estimation device includes an autocorrelation function calculation unit which calculates a normalized autocorrelation function from a perceptual weighing filtered speech signal, a maximum autocorrelation function and lag estimation unit which estimates a maximum autocorrelation function and candidates for the maximum autocorrelation function, a pitch candidate decision unit which decides candidates for a pitch by using the ratio of the estimated maximum autocorrelation function to the candidates for the estimated maximum autocorrelation function, and lags of which values are smaller than a predetermined threshold value, and a pitch estimation unit which estimates a pitch between the candidates for a pitch and the lags corresponding to the estimated maximum autocorrelation function by using a pitch of a previous frame of the speech signal.

8 Claims, 6 Drawing Sheets

| | LAG | AUTOCORRELATION R(d) |
|---|---|---|
| $d_{max}$ | 41 | 1970 |
| $d_1$ | 21 | 1956 |

| | LAG | AUTOCORRELATION R(d) | K(dx) |
|---|---|---|---|
| $d_{max}$ | 91 | 6351 | |
| $d_s$ | 46 | 6256 | 0.0177 |
| $d_2$ | 30 | 3340 | 0.4674 |
| $d_1$ | 17 | 2133 | 1.1652 |

METHOD OF ESTIMATING PITCH BY USING RATIO OF MAXIMUM PEAK TO CANDIDATE FOR MAXIMUM OF AUTOCORRELATION FUNCTION AND DEVICE USING THE METHOD

BACKGROUND OF THE INVENTION

This application claims the priority of Korean Patent Application No. 2002-61787, filed on 10 Oct. 2002, in the Korean Intellectual Property Office, the disclosure of which is incorporated herein in its entirety by reference.

1. Field of the Invention

The present invention relates to a method for improving an open-loop pitch estimation device used in a speech COder/DECoder (CODEC) and an apparatus using the method, and more particularly, to a method of pitch by using the ratio of a maximum peak to a candidate for the maximum of an autocorrelation function of a perceptual weighting filtered speech signal, and an apparatus using the method.

2. Description of the Related Art

In general code excited linear prediction (CELP) type speech CODEC, a linear prediction coefficient (LPC) presenting a spectrum envelope, a pitch showing periodical characteristics, and a fixed codebook parameter for modeling a residual signal of a LPC analysis filter are extracted from input speech signal. Then, a speech signal is reconstructed by using those extracted information.

FIG. 1 is a block diagram of a general encoder of the CELP type CODEC. Referring to FIG. 1, a pre-processing unit 101 performs general pre-processing such that it band-pass filters and pre-emphasizes an input speech signal. An LPC analyzing/quantizing unit 102 calculates a linear prediction (LP) coefficient and quantizes the LP coefficient for transmission. A signal inputted to a synthesis filter 103 is modeled as a fixed codebook 104 and an adaptive codebook 105. A pitch estimation unit 106 finds the lag having a most similar signal with the perceptual weighting filtered signal from the adaptive codebook 105, and the lag found by the pitch estimation unit 106 is called a pitch. Since the search of the adaptive codebook 105 requires a large number of calculations, an approximate pitch is calculated firstly through a search of an open-loop, and then the adaptive codebook 105 is searched for only lags in the neighborhood of the approximate pitch. A fixed codebook estimation unit 107 obtains a fixed codebook index most adequate for modeling a residual signal of an LPC analysis filter from which pitch information is removed. After the fixed codebook index and a pitch lag are estimated, a gain of each codebook is calculated, and it is quantized by a gain quantizing unit 109 for transmission.

FIG. 2 is a block diagram of a decoder of a CELP type speech CODEC. In the decoder, the speech signal is reconstructed by the parameters extracted in the encoder. After the excitation signal reproduced by using a fixed codebook 201 and an adaptive codebook 202 that are the same as used in the encoder passes through a synthesis filter 203, a speech signal is synthesized. Here, the quality of the synthesized speech is enhanced by a post-processing filter 204, reflecting human perceptual characteristics.

In general, the pitch estimation unit 106 includes an open-loop pitch estimation device and a closed-loop pitch estimation device. In the open-loop pitch estimation device, a lag having the maximum autocorrelation is selected as a pitch based on the weighted speech signal. Here, some errors may occur such that a multiple or a sub-multiple of an actual pitch lag may be selected as a pitch. In particular, a multiple of an actual pitch lag is frequently selected as a pitch. In the closed-loop pitch estimation device, the pitch is estimated by analysis-synthesis algorithm for the lags in the neighborhood of a pitch estimated in the open-loop pitch estimation device. Therefore, if the multiple or the sub-multiple of the actual lag may be selected as a pitch, namely, if an error is made in the open-loop search, the error cannot be corrected in the closed-loop search. Thus, the quality of the synthesized speech is degraded. Accordingly, in the open-loop pitch estimation device, a pitch should be estimated by a simple method which requires a small number of calculations, and the multiple or the sub-multiple of the actual lag should not be selected as the pitch.

In order to reduce errors in the open-loop pitch estimation device, many algorithms have been suggested and been used, and an open-loop search used in a conventional speech CODEC is conducted in following two ways.

In the open-loop pitch estimation device applied in the ITU-T G.729 and the GSM EFR, a search range is divided into three sections. Three maximums of the correlation function are found in three sections, and then normalized by the energy. The winner among the three normalized maximum correlation is selected by favoring the lags with the values in the lower sections. However this algorithm do not work well with both female and male speakers. Generally, the pitch of male speaker is larger than that of female speaker. Thus this algorithm may cause the sub-multiple error for male speakers.

In AMR-WB, which is selected as a new standard wideband speech CODEC by the third generation partnership project (3GPP) and International Telecommunication Union—Telecommunication Standardization Bureau (ITU-T), a pitch estimation algorithm using a pitch of a previous frame is used. The pitch estimation device in this new standard wideband speech CODEC applies weight to an autocorrelation function of a low lag. If a current frame is decided to voiced frame, weight is applied to the autocorrelation function of the lag in the neighborhood of the pitch of the previous frame. Here, the pitch of the previous frame is determined by median filtering pitches of the previous 5 frames. This method of estimating a pitch is influenced by correctness of the pitch, and if the pitch of the previous frame is a multiple of the pitch of the current frame, an error can occur. For example, if a pitch of the previous frame is a multiple of the actual pitch of the current frame in a neighborhood of transition area, the autocorrelation function has peaks at every multiple of the pitch of the previous frame, and weight is applied to the autocorrelation function value for the multiple lag of the actual pitch. Thus, the multiple lag is estimated as a pitch.

SUMMARY OF THE INVENTION

To solve the above-described and related problems, it is an object of the present invention to provide a method of estimating a correct pitch by using the ratio of the maximum peak to the candidate for maximum of an autocorrelation function of a speech signal, and an apparatus using the method.

According to an aspect of the present invention, there is provided an open-loop pitch estimation device of a speech CODEC which estimates a pitch of an input speech signal, the device comprising an autocorrelation function calculation unit which calculates a normalized autocorrelation function from a perceptual weighting filtered speech signal that is perceptual weighting filtered, a maximum autocorrelation function and a lag estimation unit which receives the autocorrelation function and estimates a maximum autocorrelation function, a lag having the maximum autocorrelation function, candidates for the maximum autocorrelation function and lags corresponding to the candidates for the maximum autocorrelation function, a pitch candidate decision unit which decides a candidate for a pitch by using the ratio of the estimated maximum autocorrelation function to the candidates for the estimated maximum autocorrelation function, and the ratio of the lags having the estimated maximum autocorrelation function to the lags corresponding to the candidates for the estimated maximum autocorrelation function, and a pitch estimation unit which estimates a pitch between the candidate for a pitch and the lag corresponding to the estimated maximum autocorrelation function by using a pitch of a previous frame of the speech signal.

A method of estimating a pitch in an open-loop pitch estimation unit of a speech CODEC which estimates a pitch of an inputted speech signal, the method comprising (a) calculating a normalized autocorrelation function from a perceptual weighting filtered speech signal, (b) estimating a maximum autocorrelation function, a lag having the maximum autocorrelation function, candidates for the maximum autocorrelation function and lags corresponding to the candidates for the maximum autocorrelation function, (c) deciding a candidate for a pitch by using the ratio of the estimated maximum autocorrelation function to the candidates for the estimated maximum autocorrelation function and the ratio of the lags having the estimated maximum autocorrelation function to the lags corresponding to the candidates for the estimated maximum autocorrelation function, and (d) receiving a pitch of a previous frame of the inputted speech signal and estimating a pitch between the candidate for a pitch and the lag having the estimated maximum autocorrelation function.

Step (b) is characterized by determining the greatest one of the normalized autocorrelation functions as the estimated maximum autocorrelation function and determining the maximum autocorrelation functions prior to the estimated maximum autocorrelation function as the candidates for the estimated maximum autocorrelation function.

Step (c) is characterized by calculating $K(d_x)$ for the candidates for the estimated maximum autocorrelation function by a formula $K(d_x)=a\ K_{log}(d_x)+(1-a)K_{corr}(d_x)$, x=1, 2, 3, . . . , l and determining the lag that is smaller a predetermined threshold between the lags dmax and K(dx) as the candidate for a pitch, wherein a denotes a predetermined weight, $K_{log}(d_x)$ is calculated by a formula $K_{lag}(d_x)=|[d_{max}/d_x+0.5]-d_{max}/d_x|$, l denotes the number of candidates for the maximum autocorrelation function prior to the estimated maximum autocorrelation function, $d_x$ denotes a lag of the candidate for the maximum autocorrelation function, and $K_{corr}(d_x)$ is calculated by a formula $K_{corr}(d_x)=|1-R(d_{max})/R(d_x)|$.

Step (d) is characterized by estimating a lag that is nearest to the pitch of the previous frame among candidates for a pitch by using the pitch of the previous frame.

BRIEF DESCRIPTION OF THE DRAWINGS

The above object and advantages of the present invention will become more apparent by describing in detail-preferred embodiments thereof with reference to the attached drawings in which.

DETAILED DESCRIPTION OF THE INVENTION

The present invention now will be described more fully with reference to the accompanying drawings, in which preferred embodiments of the invention are shown. This invention may, however, be embodied in many different forms and should not be construed as being limited to the embodiments set forth herein; rather, these embodiments are provided so that this disclosure will be thorough and complete, and will fully convey the concept of the invention to those skilled in the art.

A pitch estimation device generally used in a speech CODEC includes an open-loop pitch estimation device and a closed-loop pitch estimation device to enhance efficiency of calculations. In the open-loop pitch estimation device, a pitch is calculated by a rather simple algorithm, and the closed-loop pitch estimation device searches for more correct pitch by synthesizing and analysing the lag searched for by the open-loop pitch estimation device. In the closed-loop pitch estimation device, a pitch is searched for within a range of ±a of the pitch which is searched for in the open-loop pitch estimation device. Thus, if the multiple or the sub-multiple of the actual pitch is estimated as a pitch in the open-loop pitch estimation device, this error cannot be corrected by the closed-loop pitch estimation device. This degrades the quality of synthesized speech. The open-loop pitch estimation device according to the present invention needs a small number of calculations and minimizes the error in which the multiple or the sub-multiple of the actual pitch is selected as a pitch, thereby improving a quality of a synthesized speech of the speech CODEC.

The autocorrelation function is calculated based on a perceptual weighing filtered speech signal through the perceptual weighting filter and normalized between the minimum and the maximum lag which are predetermined. After that, the maximum autocorrelation function and a corresponding lag are calculated. The candidate for the maximum autocorrelation function and corresponding lag during the calculation of the maximum autocorrelation function are calculated. Then, the ratio of the maximum autocorrelation function to the candidate for the maximum autocorrelation function, and the ratio of the lags corresponding to them are calculated. The lags that are smaller than a predetermined threshold are determined as the candidates for a pitch. After that, among the lag having the maximum autocorrelation function and the candidate for the maximum autocorrelation function, a lag that is in the neighbourhood of the pitch of the previous frame is selected as a pitch.

Hereinafter, the present invention will be described in more detail with reference to accompanying drawings.

Figure 1:
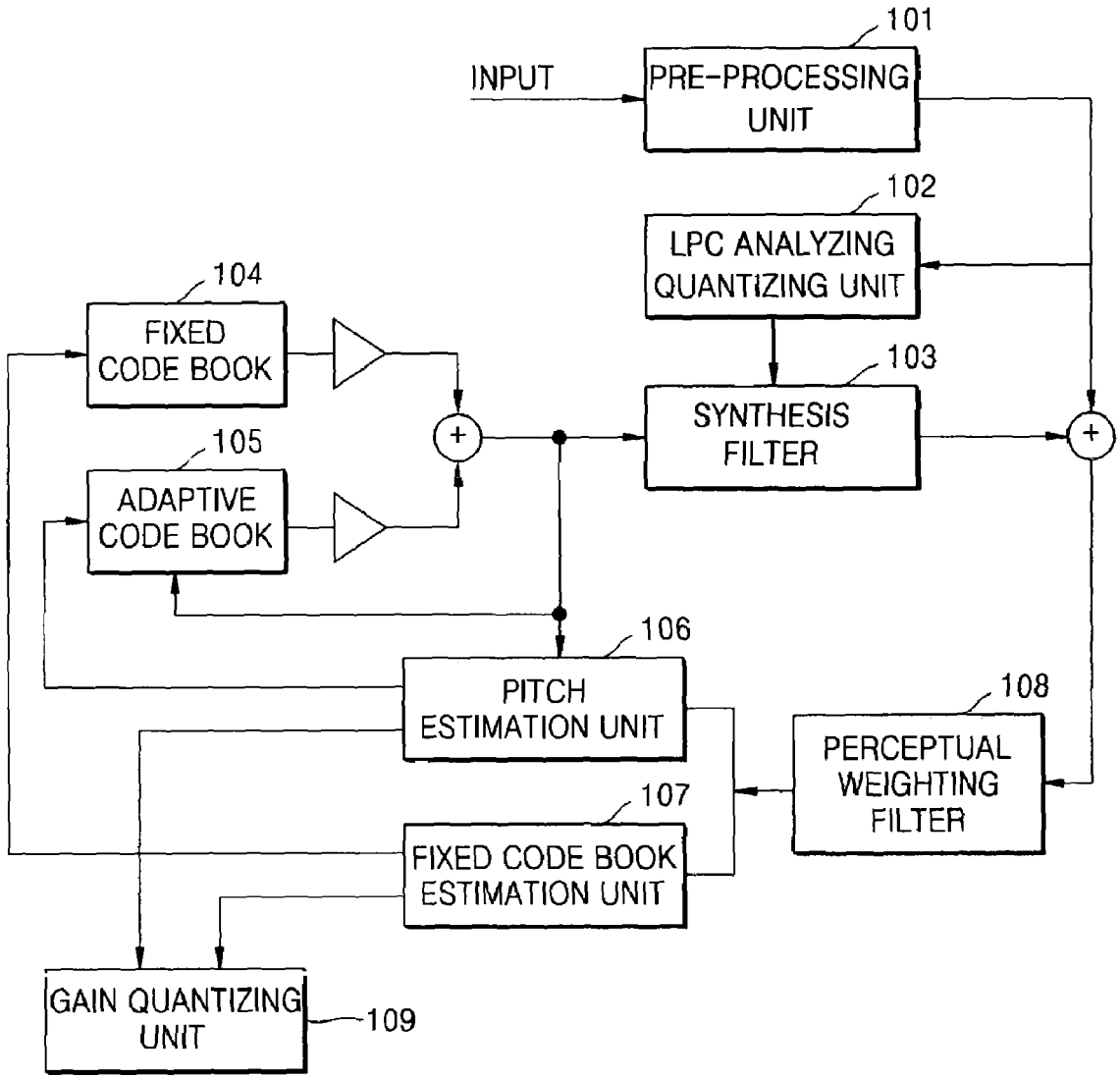
FIG. 1 is a block diagram of an encoder of a CELP speech CODEC.
Figure 2:
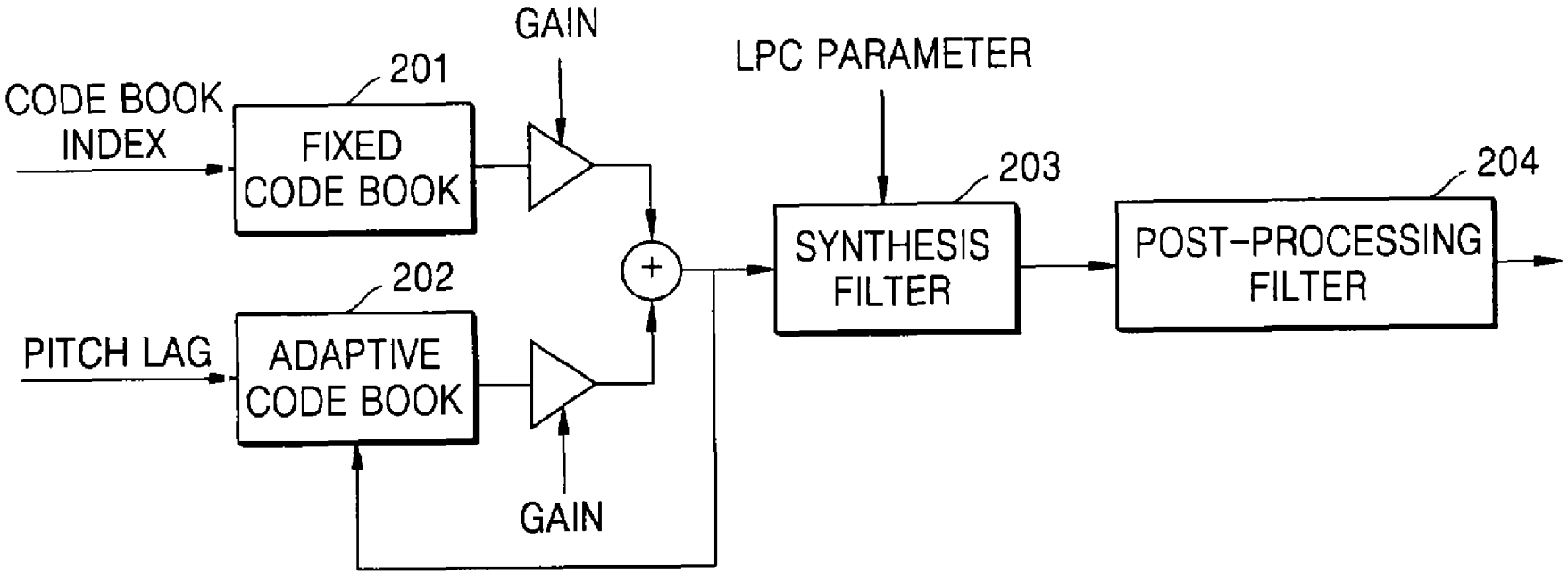
FIG. 2 is a block diagram of a decoder of a CELP speech CODEC.
Figures 3, 4:
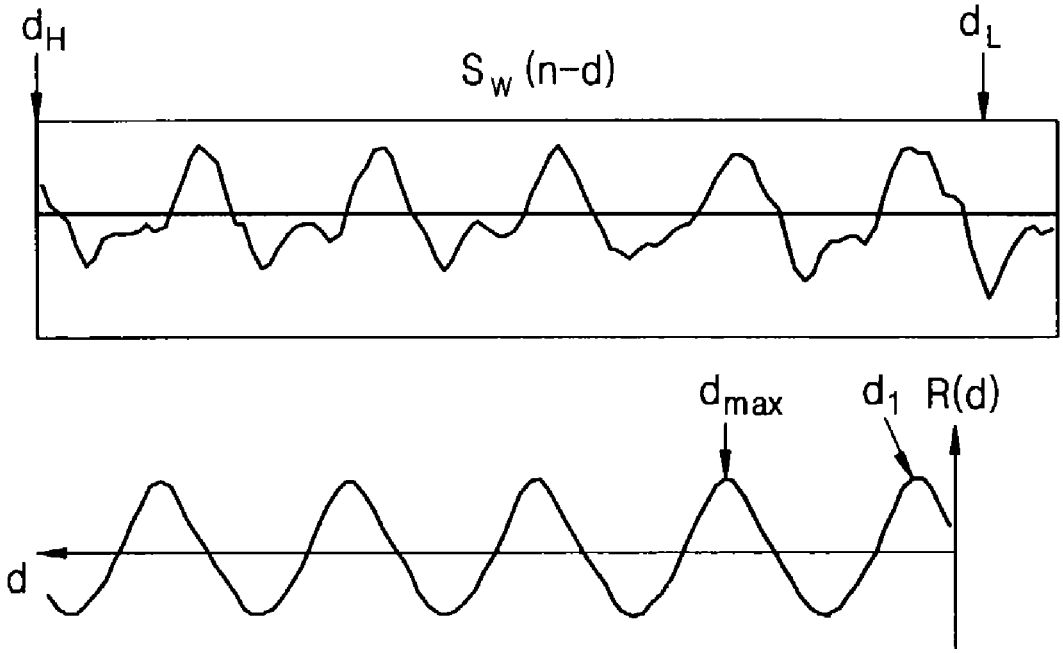
FIG. 3 is a view for explaining a perceptual weighing filtered speech signal of women, which is perceptually weighting filtered, and a normalized autocorrelation function.
FIG. 4 shows autocorrelation functions of $d_{max}$ of FIG. 3 and $d_x$.
Figure 5:
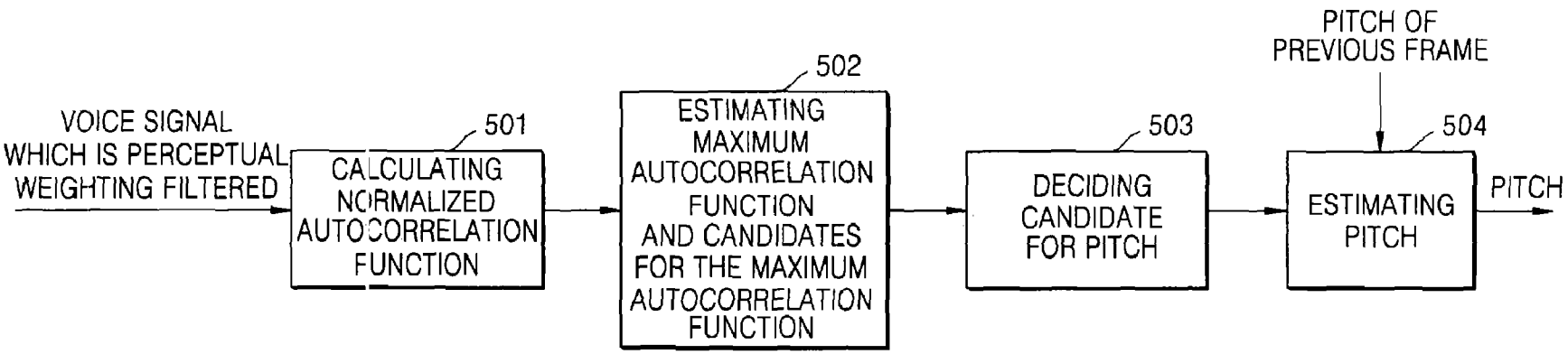
FIG. 5 is a view of an open-loop pitch estimation unit according to the present invention.
Figure 6:
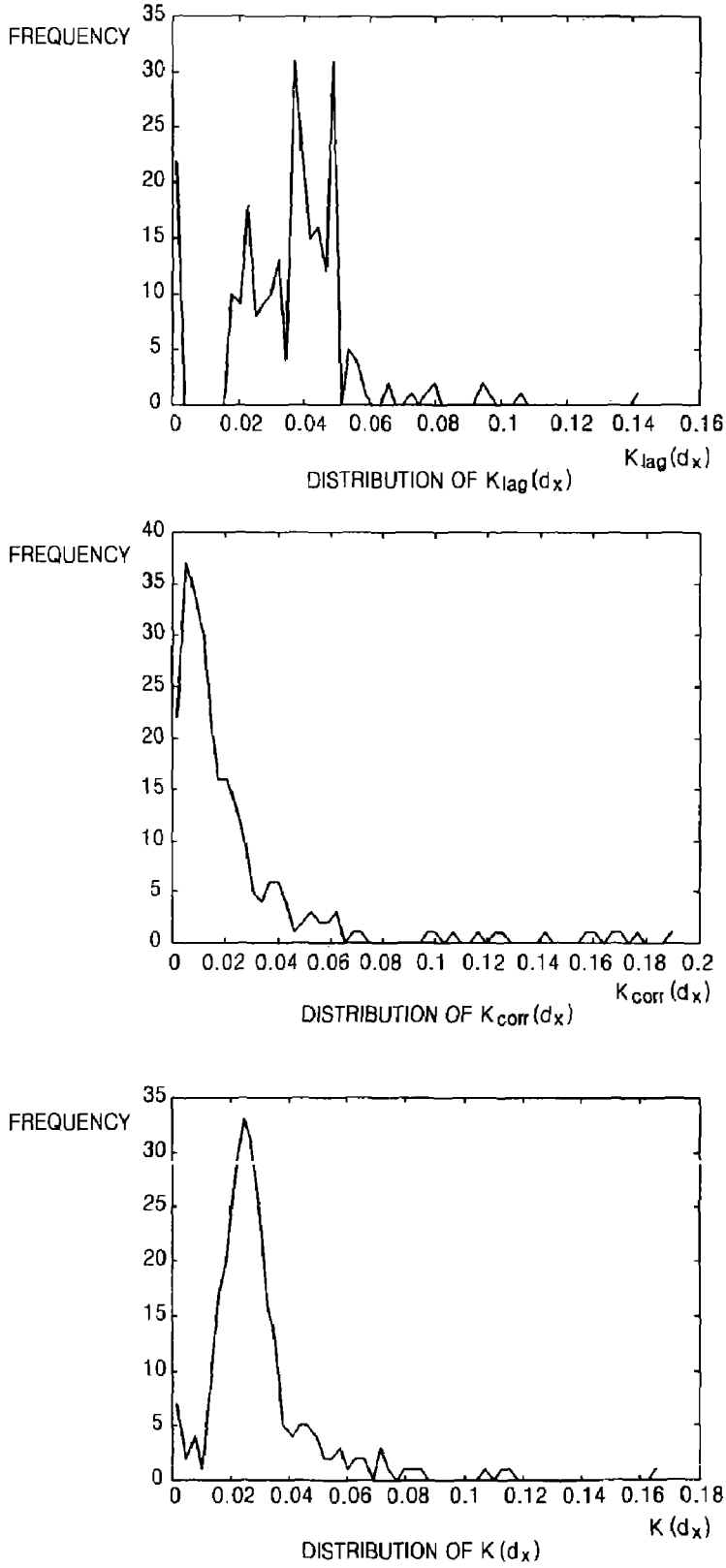
FIG. 6 is a distribution view of $K(d_x)$ for a frame where a multiple of a pitch is estimated as the pitch when a lag of the maximum autocorrelation function is selected as the pitch.
Figures 7, 8:
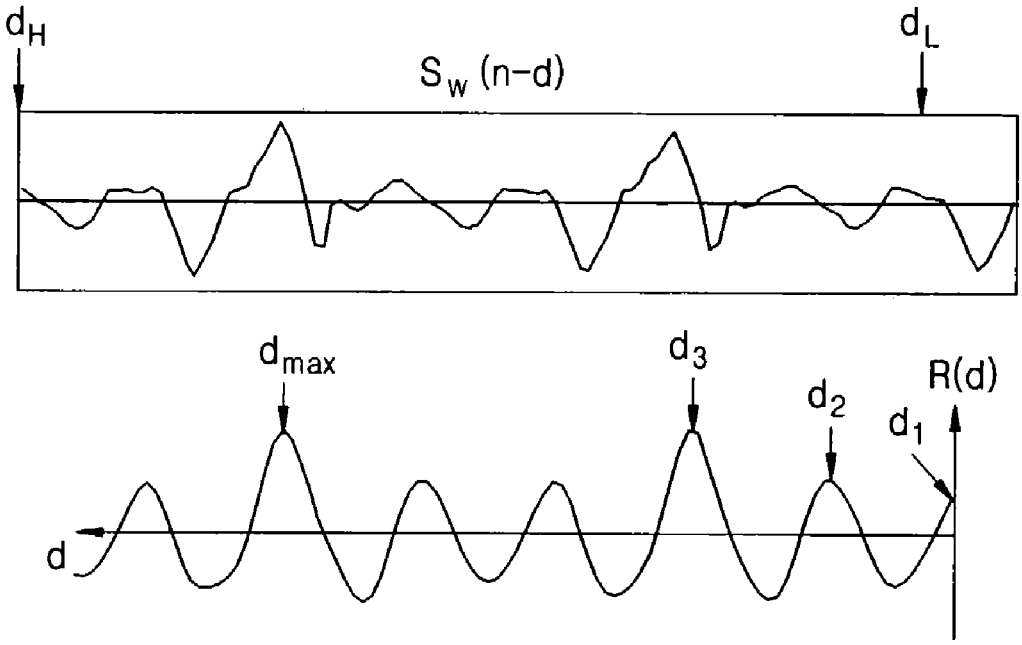
FIG. 7 shows a perceptual weighing filtered speech signal of a man, which is perceptually weighting filtered, and a normalized autocorrelation function.
FIG. 8 is for explaining $K(d_x)$ for $d_x$ of FIG. 7.

FIG. 3 is a view for explaining a perceptual weighing filtered speech signal of a woman, and a normalized autocorrelation function. FIG. 4 shows autocorrelation functions of $d_{max}$ and $d_x$ of FIG. 3. FIG. 5 is a view of an open-loop pitch estimation unit according to the present invention. FIG. 6 is a distribution view of $K(d_x)$ for a frame where a multiple of a pitch is estimated as the pitch when a lag of the maximum autocorrelation function is selected as the pitch. FIG. 7 is a view of a perceptual weighing filtered speech signal of a man, and a normalized autocorrelation function. FIG. 8 is for explaining $K(d_x)$ for $d_x$ of FIG. 7. The drawings mentioned above will be referred to when needed.

An autocorrelation function calculation unit calculates a normalized autocorrelation function based on a perceptual weighing filtered speech signal $s_w(n)$ passing through the perceptual weighting filter (501). The normalized autocorrelation function R(d) is expressed as follows, $$R(d) = \frac{\sum_{n=0}^{N-1} s_w(n-d)s_w(n)}{\sqrt{\sum_{n=2}^{N-1} s_w(n-d)^2}} \quad (1)$$

where d denotes a lag, and $d_L$, $d_H$, and N denote a minimum lag, a maximum lag and a window size for a pitch search, respectively. R(d) has a great value when $s_w(n)$ are similar with $s_w(n-d)$. Therefore, if $s_w(n)$ is a periodic signal having a period of P, R(d) has a peak for every multiple of the period of P. Although a lag has the maximum autocorrelation function when the lag has a period of P, the lag may have the maximum of the autocorrelation function when the lag has the multiple period of the period of P. At this time, the lag having the maximum autocorrelation function is selected as a pitch, a multiple pitch errors occur. In particular, the multiple pitch errors more frequently occur in speech signals of women having a short period, than in speech signals of men.

FIG. 3 shows a previous perceptual weighing filtered speech signal $s_w(n-d)$ that is perceptually weighting filtered for the speech signal of women, and R(d). For the pitch search, a lag d is selected when R(d) has the maximum of the autocorrelation function with increasing the lag from $d_L$ to $d_H$. Referring to FIG. 3, R(d) has the maximum of the autocorrelation function when the lag is $d_{max}$. However, if $d_{max}$ is estimated as a pitch, the lag two times the actual pitch is estimated as a pitch. That is, the multiple pitch error occurs. The normalized autocorrelation function R(d) has a peak during every pitch period. As shown in FIG. 3, if the autocorrelation function of the multiple lag is greater than the autocorrelation function of the actual pitch, the multiple pitch error occurs. In FIG. 3, an autocorrelation function $R(d_l)$ at a lag $d_l$ is the most recent maximum of the autocorrelation function before $R(d_{max})$ is selected as the maximum of the autocorrelation function.

FIG. 4 shows the lag $d_l$, the $d_{max}$ and their autocorrelation functions. The $d_{max}$ is the lag two times the lag $d_l$, and the difference between $R(d_{max})$ and $R(d_l)$ is very small. Based upon the above facts, the lag $d_l$ may be considered as the actual pitch. However, in the present invention, a normalized autocorrelation function for predetermined minimum and maximum lags is calculated by the autocorrelation calculation unit (501), and the most recent maximum of the autocorrelation function $R(d_x)$ and a corresponding lag prior to the maximum of the autocorrelation function $R(d_{max})$ and the corresponding lag $d_{max}$ are estimated by a maximum autocorrelation function and lag estimation unit (502). Then, a pitch candidate decision unit calculates the ratio of the most recent maximum of the autocorrelation function $R(d_x)$ and the corresponding lag, and determines the candidate for the maximum of the autocorrelation function that is smaller than a predetermined threshold as a new candidate for the pitch (503). In a pitch estimation unit, a new open-loop pitch estimation method is suggested by using the pitch of the previous frame, the new candidate for the pitch and the lag having the maximum autocorrelation function in order to reduce the pitch multiple errors (504). Here, in most cases, since the lag $d_{max}$ is the actual pitch or the multiple of the actual pitch, the lag $d_{max}$ is assumed to be the multiple of the actual pitch.

Firstly, $K(d_x)$ is calculated by using the ratio of the autocorrelation functions and the ratio of the corresponding lags as follows, $$K(d_x)=a\,K_{log}(d_x)+(1-a)K_{corr}(d_x),\ x=1, 2, 3, \ldots, l \quad (2)$$

where is a weight that is applied to the ratio of the autocorrelation functions and the ratio of the lags. The weight a is 0.5 in the present invention. l denotes the number of candidates for the maximum of the autocorrelation function prior to the lag $d_{max}$.

$K_{lag}(d_x)$ denotes the ratio of the lag $d_{max}$ having the maximum autocorrelation function to the candidates for the maximum autocorrelation function prior to the lag $d_{max}$ and can be calculated as follows, $$K_{lag}(d_x)=|[d_{max}/d_x+0.5]-d_{max}/d_x| \quad (3)$$

where $K_{lag}(d_x)$ is very small if the lag $d_{max}$ is a multiple of the lag $d_x$.

In addition, the ratio of the autocorrelation functions for the lags $d_{max}$ and $d_x$ can be calculated as follows.

$$K_{corr}(d_x)=|1-R(d_{max})/R(d_x)| \quad (4)$$

As described above, since R(d) has peaks at every multiple of the pitch periods, $K_{lag}(d_x)$ is nearly equal to 1 if the lag $d_{max}$ is a multiple of the lag $d_x$. Therefore, as the difference between the autocorrelation functions of the lag $d_{max}$ and the lag $d_x$ becomes smaller, $K_{lag}(d_x)$ also becomes smaller. Thus, as K becomes smaller in equation 2, the possibility that the lag $d_{max}$ is a multiple of the lag $d_x$ becomes higher.

The pitch candidate decision unit 503 selects the lag $d_x$ as a candidate for the pitch lag, the lag $d_x$ having $K(d_x)$ that is smaller than a predetermined threshold. The predetermined threshold is an empirically found number, and FIG. 6 shows the distribution of $K(d_x)$ for a frame where the multiple pitch error occurs when the lag having the maximum autocorrelation function is estimated as a pitch to obtain the predetermined threshold. Based on the distribution shown in FIG. 6, the predetermined threshold is determined as 0.3. In the case of a speech signal of a man, the peak may be shown in the sub-multiple of the actual pitch as well as the multiple of the actual pitch.

Therefore, the pitch estimation unit 504 uses the pitch of the previous frame to prevent the sub-multiple lag of the actual pitch from being selected as a pitch. Thus, the candidate where the difference between the lag $d_{max}$ and the candidate is smallest is selected as a pitch among the candidates calculated by the pitch candidate decision unit 503.

FIG. 7 shows perceptual weighing filtered speech signals $s_w(n-d)$ and R(d) which are perceptual weighting filtered for the speech signal of a man. In FIG. 7, $d_l$, $d_2$, and $d_3$ are the lags which were selected as the maximums of the autocorrelation function prior to $d_{max}$.

FIG. 8 shows the lags, the autocorrelation function and $K(d_x)$. In FIG. 8, $d_3$ where $d_{max}$ and $K(d_x)$ are smaller than the predetermined threshold is determined as the candidate for a pitch. The pitch of the previous frame is 45, and thus $d_3$ is selected as a pitch.

The pitch estimation method of FIG. 5 can be described as follows.

The autocorrelation function calculation unit calculates a normalized autocorrelation function by using a perceptual weighing filtered speech signal that is perceptual weighting filtered (501). Here, the normalized autocorrelation function R(d) is calculated through equation 1. Then, the normalized autocorrelation function that is calculated by the autocorrelation function calculation unit is input to the maximum autocorrelation function and lag estimation unit (501), and the maximum autocorrelation function and lag estimation unit estimates the maximum autocorrelation function and the corresponding lag, then the candidate for the maximum autocorrelation function and the corresponding lag (502).

The pitch candidate decision unit calculates $K(d_x)$ corresponding to the candidates for the maximum autocorrelation function by using the ratio of the maximum autocorrelation function to the candidate for the maximum autocorrelation function, and the ratio of the corresponding lag for the maximum autocorrelation function to the corresponding lag for the candidate for the maximum autocorrelation function (503). Then, the pitch candidate decision unit decides the lag having $K(d_x)$ that is smaller than a predetermined threshold as a candidate for a pitch (503).

The pitch estimation unit determines the lag, which is nearest to the pitch of the previous frame between the candidate for the pitch and the lag having the maximum autocorrelation function, as a pitch (504).

The embodiments of the present invention may be embodied as a computer readable program and in a general purpose digital computer by running a program from a computer usable medium.

The computer usable medium includes but not limited to magnetic storage media (e.g., ROM's, floppy disks, hard disks,) and optically readable media (e.g., CD-ROMs, DVDs).

In a speech CODEC adopting the CELP, a LPC parameter indicating a spectrum envelope from a speech signal of a frame, a pitch having a periodic characteristic of the speech signal, and information on an excitation signal that is modeled as a fixed codebook are sampled, and a speech signal are synthesized by using the information sampled. Here, a multiple or a sub-multiple of a pitch that occur when a pitch is estimated degrades a quality of a synthesized speech. Estimation of a correct pitch plays an important role in improving the quality of the synthesized speech in the speech CODEC. The open-loop pitch estimation device according to the present invention needs the small number of calculations and the multiple or the sub-multiple of the pitch when compared to a conventional algorithm. Thus, the open-loop pitch estimation device helps improving the quality of the speech in the speech CODEC.

While this invention has been particularly described with reference to preferred embodiments thereof, it will be understood by those skilled in the art that various changes in form and details may be made therein without departing from the spirit and scope of the invention as defined by the appended claims and equivalents thereof.

What is claimed is:

1. An open-loop pitch estimation device of a speech CODEC which estimates a pitch of an input speech signal, the device comprising:

an autocorrelation function calculation unit which calculates a normalized autocorrelation function from a perceptual weighing filtered speech signal;

a maximum autocorrelation function and a lag estimation unit which receives the autocorrelation function and estimates a maximum autocorrelation function, a lag having the maximum autocorrelation function, candidates for the maximum autocorrelation function and lags corresponding to the candidates for the maximum autocorrelation function;

a pitch candidate decision unit which decides a candidate for a pitch by using the ratio of the estimated maximum autocorrelation function to the candidates for the estimated maximum autocorrelation function, and the ratio of the lags having the estimated maximum autocorrelation function to the lags corresponding to the candidates for the estimated maximum autocorrelation function, and a lag smaller than a predetermined threshold as the candidate for a pitch; and a pitch estimation unit for producing a synthesized speech signal, which estimates a pitch between the candidate for a pitch and the lag corresponding to the estimated maximum autocorrelation function by using a pitch of a previous frame of the speech signal, wherein the pitch estimation unit estimates a lag that is nearest to the pitch of the previous frame between a lag that is smaller than the predetermined threshold and the lag having the maximum autocorrelation function.

2. The device of claim 1, wherein the maximum autocorrelation function and lag estimation unit estimates the maximum autocorrelation function among the normalized autocorrelation functions and determines maximum autocorrelation functions prior to the estimated maximum autocorrelation function as the candidate for the maximum autocorrelation function.

3. The device of claim 1, wherein the pitch estimation unit calculates $K(d_x)$ for the candidates for the estimated maximum autocorrelation function by a formula $K(d_x)=a\,K_{log}(d_x)+(1-a)K_{corr}(d_x)$, $x=1, 2, 3, \ldots, l$, wherein a denotes a predetermined weight, $K_{log}(d_x)$ is calculated by a formula $K_{log}(d_x)=|[d_{max}/d_x+0.5]-d_{max}/d_x|$, l denotes the number of the candidate for the maximum autocorrelation function prior to the estimated maximum autocorrelation function, $d_x$ denotes a lag of the candidate for the maximum autocorrelation function, and $K_{corr}(d_x)$ is calculated by a formula $K_{corr}(d_x)=|1-R(d_{max})/R(d_x)|$.

4. A method of estimating a pitch in an open-loop pitch estimation unit of a speech CODEC which estimates a pitch of an input speech signal, the method comprising:

(a) calculating a normalized autocorrelation function from a perceptual weighing filtered speech signal;

(b) estimating a maximum autocorrelation function, a lag having the maximum autocorrelation function, candidates for the maximum autocorrelation function and lags corresponding to the candidates for the maximum autocorrelation function;

(c) deciding a candidate for a pitch by using the ratio of the estimated maximum autocorrelation function to the candidates for the estimated maximum autocorrelation function and the ratio of the lags having the estimated maximum autocorrelation function to the lags corresponding to the candidates for the estimated maximum autocorrelation function, and a lag smaller than a predetermined threshold as the candidate for a pitch; and (d) receiving a pitch of a previous frame of the input speech signal and estimating a pitch between the candidate for a pitch and the lag having the estimated maximum autocorrelation function for producing a synthesized speech signal, wherein step (d) is characterized by estimating a lag that is nearest to the pitch of the previous frame between a lag that is smaller than the predetermined threshold and the lag having the maximum autocorrelation function.

5. The method of claim 4, wherein step (b) is characterized by determining the greatest one of the normalized autocorrelation functions as the estimated maximum autocorrelation function and determining the maximum autocorrelation functions prior to the estimated maximum autocorrelation function as the candidates for the estimated maximum autocorrelation function.

6. The method of claim 5, wherein step (c) is characterized by calculating $K(d_x)$ for the candidates for the estimated maximum autocorrelation function by a formula $K(d_x)=a K_{log}(d_x)+(1-a)K_{corr}(d_x)$, x=1, 2, 3, . . . , l and determining the lag that is smaller the predetermined threshold between the lags dmax and K(dx) as the candidate for a pitch, wherein a denotes a predetermined weight, $K_{log}(d_x)$ is calculated by a formula $K_{log}(d_x)=|[d_{max}/d_x+0.5]-d_{max}/d_x|$, l denotes the number of candidates for the maximum autocorrelation function prior to the estimated maximum autocorrelation function, $d_x$ denotes a lag of the candidate for the maximum autocorrelation function, and $K_{corr}(d_x)$ is calculated by a formula $K_{corr}(d_x)=|1-R(d_{max})/R(d_x)|$.

7. The method of claim 5, wherein step (d) is characterized by estimating a lag that is nearest to the pitch of the previous frame among candidates for a pitch by using the pitch of the previous frame.

8. A computer usable medium which has instructions stored therein, which when executed cause a computer to perform a set of operations for running the method of claim 4.

* * * * *